United States Patent [19]

Wren

[11] 4,381,510

[45] Apr. 26, 1983

[54] MICROWAVE ABSORBER

[75] Inventor: Lloyd W. Wren, Valley Center, Kans.

[73] Assignee: The Boeing Co., Seattle, Wash.

[21] Appl. No.: 294,046

[22] Filed: Aug. 18, 1981

[51] Int. Cl.[3] ..... H01Q 15/02

[52] U.S. Cl. ..... 343/909; 343/18 A

[58] Field of Search ..... 343/18 A, 18 R, 872, 343/754, 909

[56] References Cited

U.S. PATENT DOCUMENTS 3,633,206 1/1972 McMillan ..... 343/909

4,118,704 10/1978 Ishino et al. ..... 343/18 A

*Primary Examiner*—David K. Moore

*Attorney, Agent, or Firm*—Edwin H. Crabtree

[57] ABSTRACT

A microwave absorber for coupling and absorbing radio frequency energy used for communication, navigation and radar systems. The structure has a conformal energy receiving surface for receipt on reflecting surfaces or surfaces supporting unwanted surface waves. The microwave absorber provides an effective means for antenna radiation pattern control, and reduction of antenna to antenna coupling caused by reflections or surface waves.

17 Claims, 11 Drawing Figures

MICROWAVE ABSORBER

BACKGROUND OF THE INVENTION

The subject invention broadly includes a structure for coupling and absorbing radio frequency energy and more particularly but not by way of limitation to a microwave absorber having lossy covered leaky transmission lines for coupling energy arriving at various angles of incidence.

Heretofore, there have been different types of antennas and radomes having dielectric coverings and strips mounted thereon. Also, the antennas and radomes have different types of geometric configurations for receiving radio frequency energy. These types of radomes and antennas are disclosed in U.S. Pat. No. 4,189,731 to Rope et al., U.S. Pat. No. 4,086,591 to Siwiak et al., U.S. Pat. No. 3,448,455 to Alfrandari et al., U.S. Pat. No. 3,576,581 to Tricoles and U.S. Pat. No. 3,002,190 to Oleesky et al.

None of the above mentioned patents disclosed the unique features and advantages of a microwave absorber for coupling and absorbing radio frequency energy as described herein.

SUMMARY OF THE INVENTION

The microwave absorber is simple in design and is adapted for receipt on various types of reflecting surfaces. The absorber may have various dimensions and geometric designs selected to receive and couple incident radio frequency energy.

The absorber is effective for coupling and absorbing energy arriving at any angle of incidence and of any polarization and converting this energy to a propagating mode and preventing reradiation of the energy.

The absorber is effective for antenna radiation pattern control and reducing the coupling of reflections and surface waves between antennas. The invention may be used with various types of communication, navigation and radar systems and mounted on various types of aircraft, ships and vehicles.

The absorber includes an energy receiving surface which is adapted for receipt on a reflecting surface. A first transmission line wall is mounted on the receiving surface and has a lossy wall covering. A second transmission line wall is mounted on the receiving surface and has a lossy wall covering. The two walls are disposed in a spaced relationship to each other and form an open channel configuration with the receiving surface.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
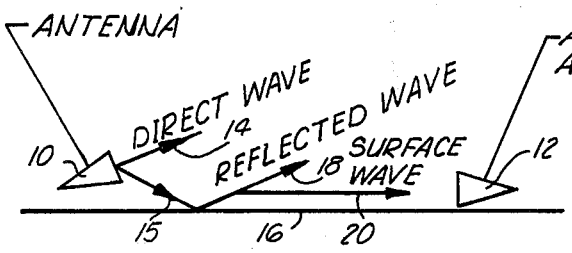
FIG. 1 illustrates the mechanism of antenna to antenna coupling and radiation pattern deterioration caused by reflected or surface waves.

In FIG. 1 an antenna 10 is shown transmitting direct energy waves indicated by arrows 14 and 15. Wave 15 is reflected off of reflecting surface 16 as reflected wave 18 which will add vectorially to the direct wave 14 causing cancellation or reinforcement of the resultant wave. The same effect results when antenna 10 is used as a receiving antenna except that the directions of waves 14, 15, and 18 are reversed with wave 18 becoming a direct wave and wave 15 becoming a reflected wave. When antenna 10 is used as a transmitting antenna, it should be noted that direct wave 15 can generate a surface wave 20 which will be received by the second antenna 12.

Figure 2:
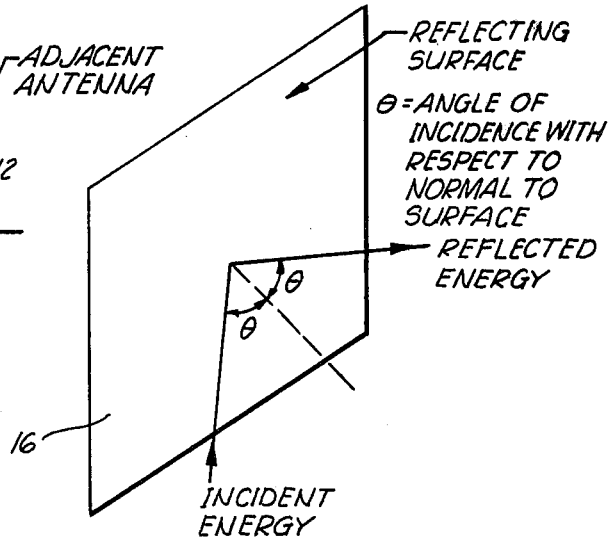
FIG. 2 illustrates the angle of incidence of reflected energy.

The antennas 10 and 12 installed in this illustration include a radiation pattern of back lobes, side lobes and depending on pointing angle the main lobe incident upon the reflective surface 16. This causes the antenna 10 to suffer a severe radiation pattern distortion due to the energy reflected indicated by the arrows 18 or 15 from the surface 16 and also generate the surface wave 20 which can propagate and couple to the adjacent antenna 12. Conventional loaded foam or loaded hair absorbers are effective for reducing reflection of energy arriving at or near normal incidence but they become increasingly ineffective as the angle of incidence as shown in FIG. 2 approaches 90 degrees. The subject invention is effective for coupling and absorbing energy arriving at any angle of incidence.

Figure 3:
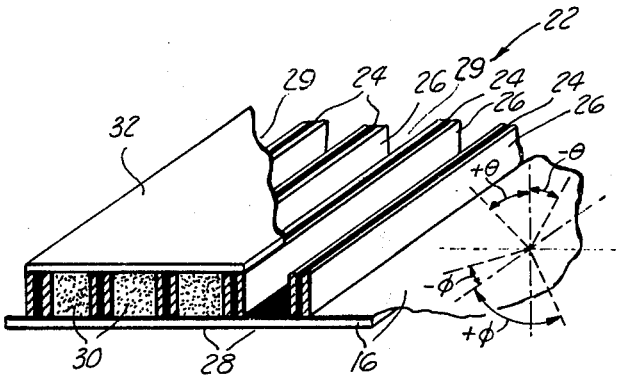
FIG. 3 illustrates the microwave absorber for mounting on a reflecting surface and coupling and absorbing radio frequency energy.
Figure 4:
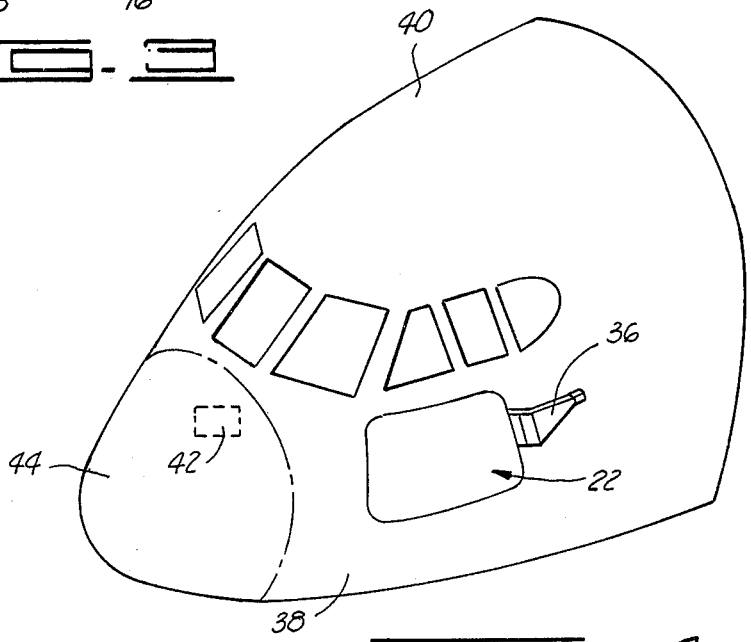
FIG. 4 illustrates a horn antenna mounted externally on a fuselage of an aircraft nose.

In FIG. 3 the subject microwave absorber is designated by general reference numeral 22. The absorber 22 includes a plurality of transmission line walls 24 having a lossy wall covering 26. The walls 24 are dimensionally and geometrically selected to couple incident radio energy of any polarization and convert this energy to a propagating mode in and between the transmission line walls 24. The lossy covering 26 contained within the transmission line walls 24 will attenuate the fields associated with the propagating modes and thus prevent re-radiation and reflection as shown in FIG. 1 and FIG. 2.

The walls 24 may be parallel or at an angle to each other and are mounted in an upright position on an energy receiving surface 28 which may be adapted for mounting on different types of reflecting surfaces 16.

The energy receiving surface 28 may or may not, as desired include a lossy surface cover similar to the lossy wall covering 26. The walls 24 and surface 28 are made of an electrical conductive material and are in electrical contact to form channel 29.

The open transmission line walls 24 have been evaluated by constructing an open conductive rectangular channel as shown in the drawing. The electrical cross-section dimensions of the channel 29 including the effects of the dielectric lossy covering 26 were selected to superimpose the cut-off frequency of the two lowest order propagating leaky modes and to place these frequencies below the lowest intended operating frequency. These modes which correspond to $TE_{10}$ and $TM_{11}$ modes in closed rectangular waveguide, will couple to perpendicular and parallel incident energy polarizations respectively.

The reflective measurements were made on a test absorber array over a 3:1 frequency bandwidth using a two horn, single bounce measurement technique. The results, which were references to the reflection from a flat metal plate, showed greater than 30 db absorption from $\theta=45°$ to $\theta=90°$. The addition of a lossy covering to the energy-receiving surface 28 between the walls 24 provides greater than 20 db absorption from $\theta=45°$ to $\theta=0°$.

As shown in FIG. 3, the channels may be filled with a low density foam 30 and covered with a thin dielectric skin 32 to provide a smooth aerodynamic surface. The absorption measurements showed negligible change in performance compared to the initial measurements without the foam 30 and skin 32.

Figure 5:
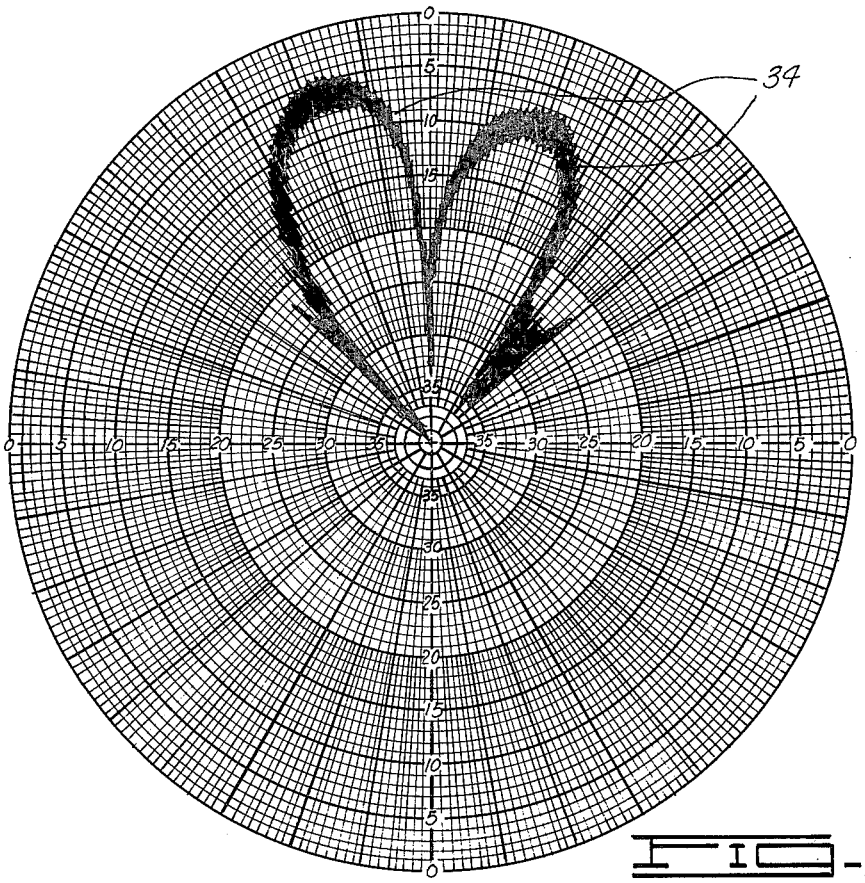
FIG. 5 illustrates a radiation difference pattern made on a dual aperture circular polarized horn antenna.
Figure 6:
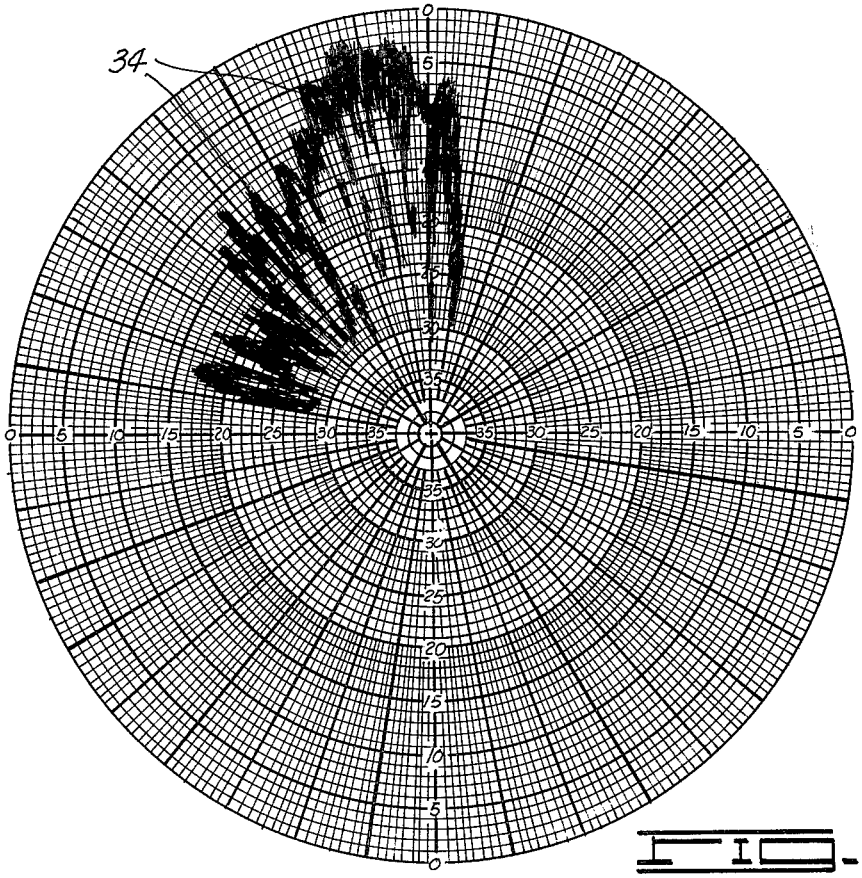
FIG. 6 illustrates a radiation difference pattern showing the effects of the fuselage reflections on the pattern without the absorber panel.

In FIG. 5 a free space radiation pattern measurement 34 is shown which was made on a dual aperture circular polarized horn antenna 36 using a rotating linear illuminating source. Difference patterns were measured using a 180° hybrid to connect the two apertures of the horn antenna 36. The antenna 36 was mounted externally on a fuselage 38 of a full scale aircraft nose mock-up 40 as shown in FIG. 5 and pointed forward and parallel to the centerline of the aircraft 40. Difference radiation pattern 34 shown in FIG. 6 on this installation shows the effects of the fuselage reflection on the pattern 34 and commonly called pattern tear up.

Figure 7:
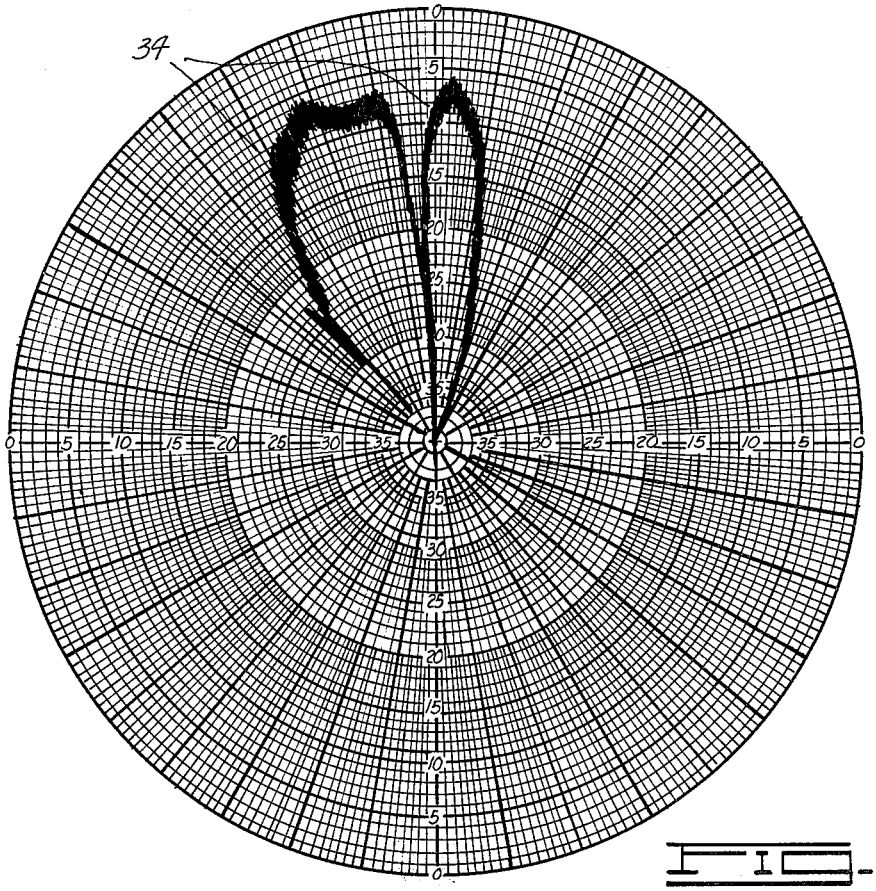
FIG. 7 illustrates the installed difference pattern using the absorber panel.

In FIG. 7 the test absorber panel 22 was then attached to the fuselage 38 ahead of the antenna 36 to cover the reflecting surface 16 and the difference pattern 34 was measured.

Isolation measurements were then made between the dual horn antenna 36 and a wide angle receiving antenna 42 mounted on the center line of the mock-up 40 under a nose radome 42 with and without the absorber panel 22. The isolation was 45 db greater with the absorber panel 22 in place.

Although the absorber configuration tested as shown in FIG. 2 was developed for a specific application, other types of transmission line walls having different geometry and dimensions can be used if provided with the property of propagating leaky transmission line modes. Performance parameters such as operating frequency range, angle of maximum coupling, polarization balance and absorption per unit length can be optimized by a choice of dimensions, geometry and different types of conductive and non-conductive material.

Figure 8:
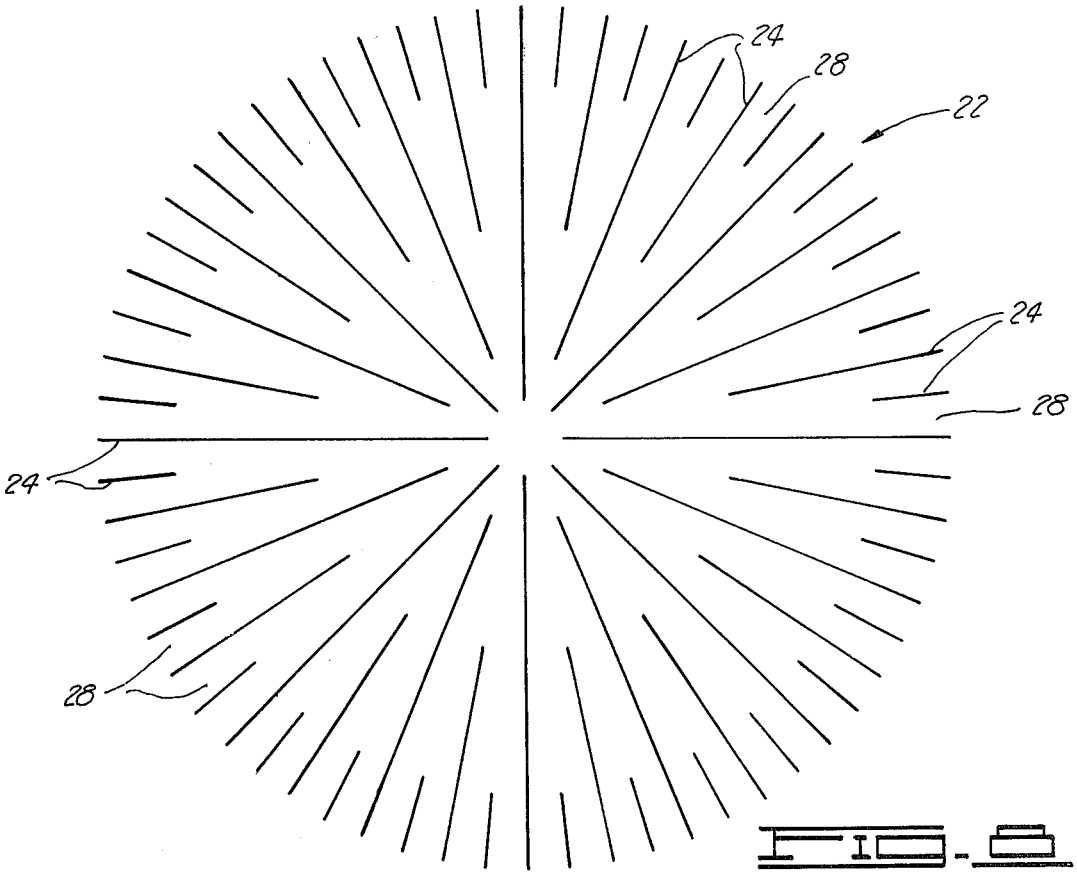
FIG. 8 illustrates a radial configuration of the microwave absorber.

The uniform parallel array of walls 24 as shown in FIG. 3 are effective for angles of $\theta$ from 0 to $\pm 90$ degrees and angles of from 0 degrees to greater than $\pm 45$ degrees. In FIG. 8 a radial configuration of the absorber panel 22 or a variation thereof may be used having the walls 24 in a radial configuration for increasing $\phi$ to $\pm 180$ degrees and a variable cross section may be used to vary the angle $\theta$ where maximum coupling to incident energy occurs.

Figure 9:
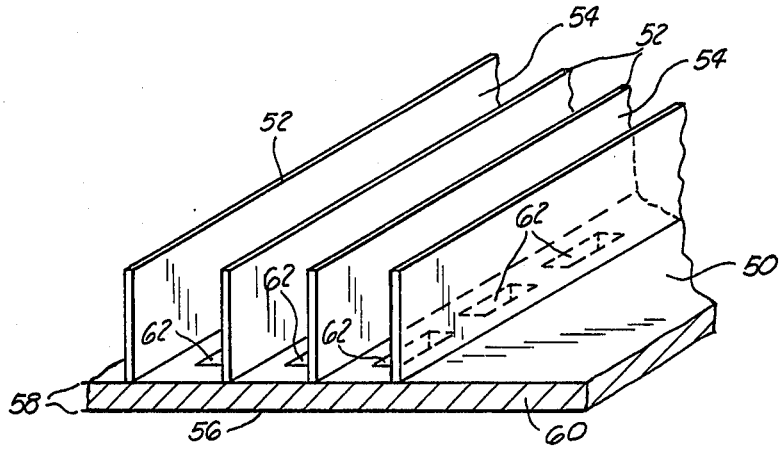
FIGS. 9, 10 and 11 illustrate alternate embodiments of the microwave absorber.

FIG. 9 illustrates a conducting receiving surface 50 on which a plurality of conducting transmission line walls 52 are mounted and forming conductive channels 54. A conducting surface 56 is spaced from and parallel to the receiving surface 50. The two surfaces 50 and 56 form a parallel plate waveguide 58 which contains a lossy dielectric filler 60 therebetween. The receiving surface 50 contains a series of open coupling apertures 62 located in the receiving surface 50 at the bottom of the channels 54. Energy which is received by the open channels 54 is transferred to the parallel plate waveguide 58 via the coupling apertures 62 and is dissipated in the lossy dielectric filler 60.

Figure 10:
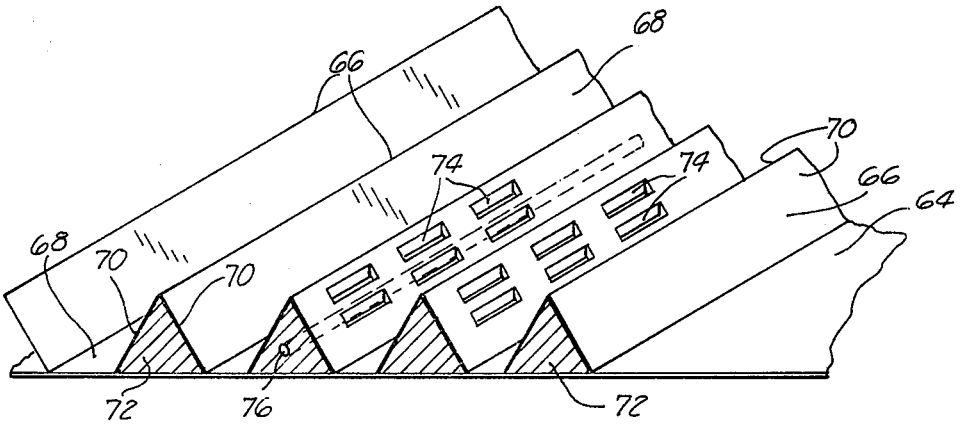

FIG. 10 illustrates a conducting receiving surface 64 on which transmission conducting line walls 66 are mounted in a manner to form conductive channels 68 and closed triangular waveguide 70. The walls 66 contain a lossy dielectric filler 72.

Energy which is received by the conductive channels 68 is transferred to the triangular waveguide 70 via open coupling apertures 74 located in the transmission line walls 66. The energy thus transferred is dissipated by the lossy dielectric filler 72. As an option, the triangular waveguide 70 could contain a parallel conductive center conductor 76 spaced and insulated from the conductive walls 66 and conducting surface 64. This would change the waveguide 70 to a TEM structure. The term TEM is a particular transmission line mode of propagation as opposed to the waveguide propagating modes which exist in the absence of a center conductor. As before the energy received by the conductive channels 68 is transferred via the open coupling apertures 74 to the TEM structure containing the center conductor 76 and is dissipated by the lossy dielectric filler 72. If the center conductor 76 is made resistive, then the energy is also dissipated by the center conductor 76.

Figure 11:
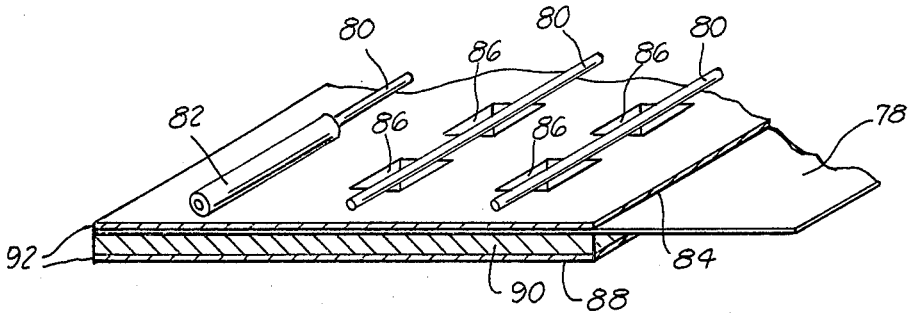

FIG. 11 illustrates a conducting receiving surface 78 having transmission line conductors 80 mounted thereon. Conductors may have a resistive covering 82 thereon. The receiving surface 78 may also have a lossy dielectric covering 84. Energy received by the conductors 80 will be dissipated by conductors 80 if they are resistive or by the lossy covering 84 or by both. Receiving surface 78 may also contain open coupling apertures 86 and spaced above a conducting surface 88 with a lossy dielectric filler 90 therebetween and forming a parallel plate waveguide 92. In this case, energy received by the conductors 80 is transferred to the parallel waveguide 92 via the coupling apertures 86 and is dissipated by the lossy dielectric filler 90.

Changes may be made in the construction and arrangement of the parts or elements of the embodiments as described herein without departing from the spirit or scope of the invention defined in the following claims.

What is claimed is:

1. A microwave absorber for a reflecting surface, the absorber coupling and absorbing radio frequency energy at different angles of incidence, the absorber including:

an energy receiving surface adapted for receipt on the reflecting surface;

a first transmission line wall mounted on the receiving surface and having a lossy wall covering; and a second transmission line wall mounted on the receiving surface and having a lossy wall covering, the second transmission line wall disposed in a spaced relationship from the first transmission line wall, the receiving surface and the first and second wall forming an open channel configuration.

2. The absorber as described in claim 1 wherein the first and second transmission line walls are parallel to each other.

3. The absorber as described in claim 1 wherein the first and second transmission line walls are positioned at an angle to each other.

4. The absorber as described in claim 1 wherein the transmission line walls are made of an electrically conductive material.

5. The absorber as described in claim 1 wherein the energy receiving surface includes a lossy surface cover.

6. The microwave absorber as described in claim 1 wherein the open channel between the first and second walls is filled with a non-conductive foam material with the top of the walls and the foam covered with a thin skin of dielectric material.

7. A microwave absorber for a reflecting surface, the absorber coupling and absorbing radio frequency energy at different angles of incidence, the absorber including:

an electrically conductive energy receiving surface having a lossy surface covering and adapted for receipt on the reflecting surface;

a first electrically conductive transmission line wall mounted on the energy receiving surface and having a lossy wall covering; and a second electrically conductive transmission line wall mounted on the energy receiving surface and having a lossy wall covering, the second transmission line wall disposed in a spaced relationship from the first transmission line wall, the energy receiving surface and the first and second wall forming an open channel configuration.

8. The absorber as described in claim 7 wherein the open channel between the first and second walls is filled with a non-conductive foam material with the top of the walls and the foam covered with a thin skin of dielectric material.

9. A microwave absorber for a reflecting surface, the absorber coupling and absorbing radio frequency energy at different angles of incidence, the absorber including:

an energy receiving surface adapted for receipt on the reflecting surface;

a first transmission line conductor mounted above the receiving surface; and a second transmission line conductor mounted above the receiving surface, the second transmission line conductor disposed in a spaced relationship from the first transmission line conductor and the receiving surface, the energy receiving surface and the first and second wall forming an open channel configuration and the transmission line conductors are covered with a lossy material.

10. The absorber as described in claim 9 wherein the first and second transmission line conductors are parallel to each other.

11. The absorber as described in claim 9 wherein the first and second transmission line conductors are positioned at an angle to each other.

12. The absorber as described in claim 9 wherein the receiving surface is covered with a lossy material.

13. The absorber as described in claim 9 wherein the energy coupled by the transmission line conductors is transferred to and absorbed by an adjacent and underlying structure mounted below the receiving surface.

14. A microwave absorber for a reflecting surface, the absorber coupling and absorbing radio frequency energy at different angles of incidence, the absorber including;

an energy receiving surface adapted for receipt on the reflecting surface;

a first transmission conducting line wall mounted on the receiving surface; and a second transmission conducting line wall mounted on the receiving surface, the second transmission line wall disposed in a spaced relationship from the first transmission line wall, the receiving surface and the first and second wall forming an open channel configuration and the transmission line conductors are covered with a lossy material.

15. The absorber as described in claim 14 wherein the first and second transmission line walls are parallel to each other.

16. The absorber as described in claim 14 wherein the first and second transmission line walls are positioned at an angle to each other.

17. The absorber as described in claim 14 wherein the energy coupled by the open channel is transferred to and absorbed by an adjacent and underlying structure mounted below the receiving surface.

* * * * *